US008684111B2

(12) United States Patent
Bell et al.

(10) Patent No.: US 8,684,111 B2
(45) Date of Patent: Apr. 1, 2014

(54) CORE DRILL BIT

(75) Inventors: Andy Bell, Wymeswold (GB); Raymond Purser, New South Wales (AU)

(73) Assignee: Sandvik Intellectual Property AB, Sandviken (SE)

( * ) Notice: Subject to any disclaimer, the term of this patent is extended or adjusted under 35 U.S.C. 154(b) by 238 days.

(21) Appl. No.: 13/058,943

(22) PCT Filed: Jun. 15, 2009

(86) PCT No.: PCT/SE2009/050736

§ 371 (c)(1), (2), (4) Date: Apr. 7, 2011

(87) PCT Pub. No.: WO2010/019092

PCT Pub. Date: Feb. 18, 2010

(65) Prior Publication Data

US 2011/0174546 A1 Jul. 21, 2011

(30) Foreign Application Priority Data

Aug. 15, 2008 (AU) ..... 2008205690

(51) Int. Cl.
*E21B 10/02* (2006.01)
*E21B 10/48* (2006.01)

(52) U.S. Cl.
CPC ..... *E21B 10/48* (2013.01); *E21B 10/02* (2013.01)
USPC ..... 175/405.1; 175/403; 175/428

(58) Field of Classification Search
USPC ..... 175/403, 405.1, 248
See application file for complete search history.

(56) References Cited

U.S. PATENT DOCUMENTS

| | | | | | |
|---|---|---|---|---|---|
| 2,174,980 | A | * | 10/1939 | Heath et al. | 175/405.1 |
| 2,187,384 | A | * | 1/1940 | Maier | 175/405.1 |
| 2,326,908 | A | * | 8/1943 | Williams, Jr | 175/405.1 |
| 2,506,388 | A | * | 5/1950 | Ross | 175/384 |
| 3,382,940 | A | | 5/1968 | Stebley | |
| 3,610,768 | A | * | 10/1971 | Cochran | 408/204 |
| 3,726,351 | A | * | 4/1973 | Williams, Jr. | 175/426 |
| 4,098,362 | A | * | 7/1978 | Bonnice | 175/430 |
| 2008/0128170 | A1 | | 6/2008 | Drivdahl et al. | |
| 2008/0142262 | A1 | | 6/2008 | Drivdahl et al. | |

OTHER PUBLICATIONS

Office Action (with English translation) for Chilean Patent Application No. 321-2011, dated Feb. 5, 2013.
Notification of the First Office Action (with English translation) for Chinese Patent Application No. 200980131891.1, dated Mar. 18, 2013.
Notification of the Second Office Action (with English translation) for Chinese Patent Application No. 200980131891.1, dated Oct. 11, 2013.

* cited by examiner

*Primary Examiner* — Cathleen Hutchins
(74) *Attorney, Agent, or Firm* — Morgan, Lewis & Bockius LLP

(57) ABSTRACT

A drill bit is disclosed. The drill bit has an axis, and a barrel, and a cutting member fixed to the barrel. The barrel is arranged to engage a drill shaft for driving the drill bit around the axis. The barrel and the cutting member are adjacently located on the axis. The drill bit has an aperture centered on the axis, the aperture passing completely through both the cutting member and barrel.

21 Claims, 4 Drawing Sheets

CORE DRILL BIT

CROSS REFERENCE TO RELATED APPLICATIONS:

This application is a §371 National Stage Application of PCT International Application No. PCT/SE2009/050736, filed Jun. 15, 2009, and claims priority under 35 U.S.C. §119 and/or §365 to Australian Application No. 2008205690 filed Aug. 15, 2008.

FIELD OF THE INVENTION

The present invention generally relates to drill bits, and particularly but not exclusively to core drill bits used in the mining and construction industries.

BACKGROUND OF THE INVENTION

Core bits are used to provide core samples. In the mining industry, core samples are used for geological assessment of mineral content. In the construction industry, core samples are used to test structural integrity.

SUMMARY OF INVENTION

According to a first aspect of the present invention there is provided a cutting member for a drill bit, the cutting member being arranged to fix to a corresponding barrel for the drill bit, the barrel being arranged to engage a drill shaft.

In an embodiment, the cutting member is arranged to detachably fix to the corresponding barrel.

In the present specification, detachably fixed means the drill bit and barrel can be separated without destruction of either the barrel or cutting member.

According to a second aspect of the present invention there is provided a barrel for a drill bit, the barrel being arranged to fix to a corresponding cutting member for the drill bit and engage a drill shaft.

In an embodiment, the barrel is arranged to detachably fix to the corresponding cutting member.

According to a third aspect of the present invention there is provided a drill bit having an axis, the drill bit comprising:

a barrel;

a cutting member fixed to the barrel, the barrel being arranged to engage a drill shaft for driving the drill bit around the axis, the barrel and the cutting member being adjacently located on the axis, and an aperture centered on the axis, the aperture passing completely through both the cutting member and barrel.

In an embodiment, the cutting member is detachably fixed to the barrel.

In an embodiment, the cutting member and barrel are mechanically fixed together by a pair of engaged cooperating elements, each of the pair of elements being located on one of the barrel and cutting member respectively. The cooperating elements may be arranged to interfere when the drill bit is driven around the axis providing resistance against separation of the cutting member from the barrel. The engaging elements may comprise a pair of complimentary threads, each of the threads being formed on one of the cutting member and barrel respectively. The cooperating elements may additionally or alternatively comprise a spigot located in a corresponding recess, the spigot and recess being located on one of the cutting member and barrel respectively.

In an embodiment, the cutting member is metallurgically fixed to the barrel.

In an embodiment, the cutting member is fixed to the barrel with an adhesive.

In an embodiment, the cutting member has cylindrical inner and outer surfaces centered on the axis, the inner surface surrounding the aperture passing through the cutting member. The aperture may be cylindrical. The inner and outer surfaces may be slotted. The inner and/or outer surfaces may comprise wear resistant matrices.

In an embodiment the cutting member has a cutting face, and a backing face located adjacent the barrel, the faces being spaced apart along the axis, and the cutting face comprising a plurality of cutting teeth or elements. The cutting teeth or elements may be arranged in a ring formation. The cutting face may comprise hill and valley formations running around the axis. The cutting face may be slotted.

In an embodiment, the backing face comprises a composite having a plurality of diamonds or other super hard constituents. The backing face may comprise a circular flange arranged to engage the barrel.

In an embodiment, the cutting member comprises a plurality of elements in a layered configuration.

In an embodiment, the cutting member and barrel are formed of different materials.

In an embodiment, the cutting member is formed of one or more composite materials. The one or more composite materials may include a metal and a plurality of diamonds.

In an embodiment, the barrel has cylindrical inner and outer barrel surfaces centered on the axis, the inner barrel surface surrounding the aperture passing through the barrel. The aperture may be cylindrical. The aperture passing the barrel may be continuous with the aperture passing through the cutting member, for receiving a cylindrical core sample. The inner and/or outer barrel surfaces may comprise wear resistant matrices.

In an embodiment, the barrel is arranged to stabilize the bit during drilling. The barrel may be longer than the cutting member.

In an embodiment, the drill bit is a core bit. The barrel may be a barrel for the core bit. The cutting member may be a cutting member for the core bit.

According to a fourth aspect of the present invention there is provided a method of making a drill bit having an axis, the method comprising the steps of:

providing a cutting member;

providing a barrel separate to the cutting member, the barrel being arranged to engage a drill shaft for driving the drill bit around the axis;

locating the barrel adjacent the cutting member on the axis; and fixing the barrel to the cutting member.

BRIEF DESCRIPTION OF THE FIGURES

In order to achieve a better understanding of the nature of the present invention embodiments will now be described, by way of example only, with reference to the accompanying figures in which.

DETAILED DESCRIPTION OF EMBODIMENTS OF THE INVENTION

Figure 1:
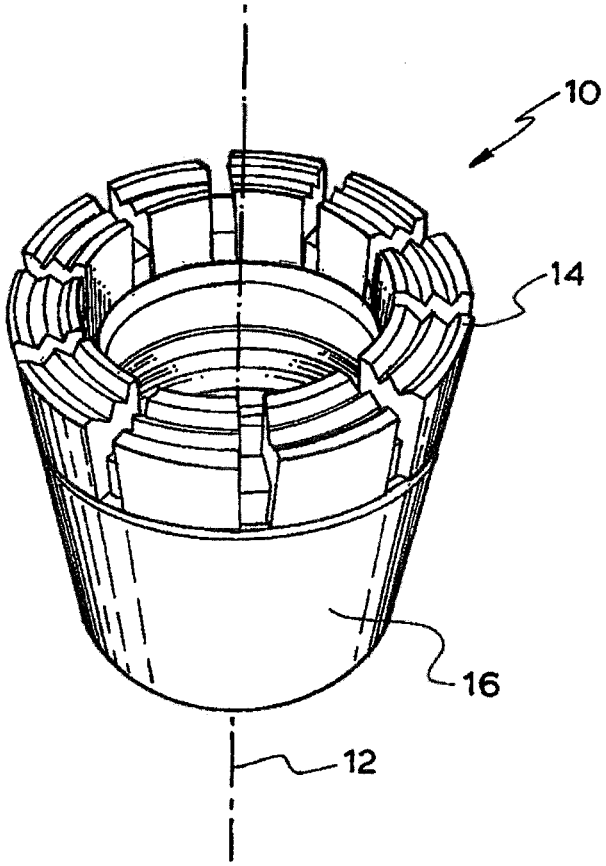
FIG. 1 shows from above a perspective view of one embodiment of a drill bit according to an aspect of the invention, comprising a cutting member and a barrel.

FIG. 1 shows one embodiment of a drill bit generally indicated by the numeral 10. The drill bit 10 has a central axis 12 around which it is driven. The drill bit 10 has a cutting member 14, in the form of a crown, detachably fixed to a separate barrel 16. The barrel 16 and the cutting member 14 are adjacently located on the axis 12. The cutting member 14 and barrel 16 are formed separately and then fixed together. The barrel 16 is arranged to engage a drill shaft (not shown) for driving the drill bit 10 around the axis 12. Typically the barrel connects to a drill string or possibly a drill chuck. In this embodiment, the drill bit 10 is a core bit, and so the barrel 16 is a barrel for the core bit 10 and the cutting member 14 is a cutting member for the core bit 10.

The cutting member 14 and barrel 16 are mechanically fixed together by a pair of engaged cooperating elements. The cooperating elements are arranged to interfere when the drill bit 10 is driven around the axis 12 providing resistance against separation of the cutting member 14 from the barrel 16. This transfers the drive power from the barrel to the cutting member. The engaging elements, in some embodiments, comprise a pair of complimentary threads, each of the threads being formed on the cutting member 14 and barrel 16 respectively. Of course, the handedness of the thread is chosen so that the barrel 16 and cutting member 14 do not separate during drilling and rotation around the axis 12 in the desired direction.

Because the threads engage each other there is no need for a separate retainer, such as a bolt, to fix the barrel to the cutting member. Some embodiments, however, may include a retainer. In some embodiment, the barrel and cutting member are detachably fixed together by the threads for example, so that they can be separated without destruction of either the barrel or cutting member.

Figure 2:
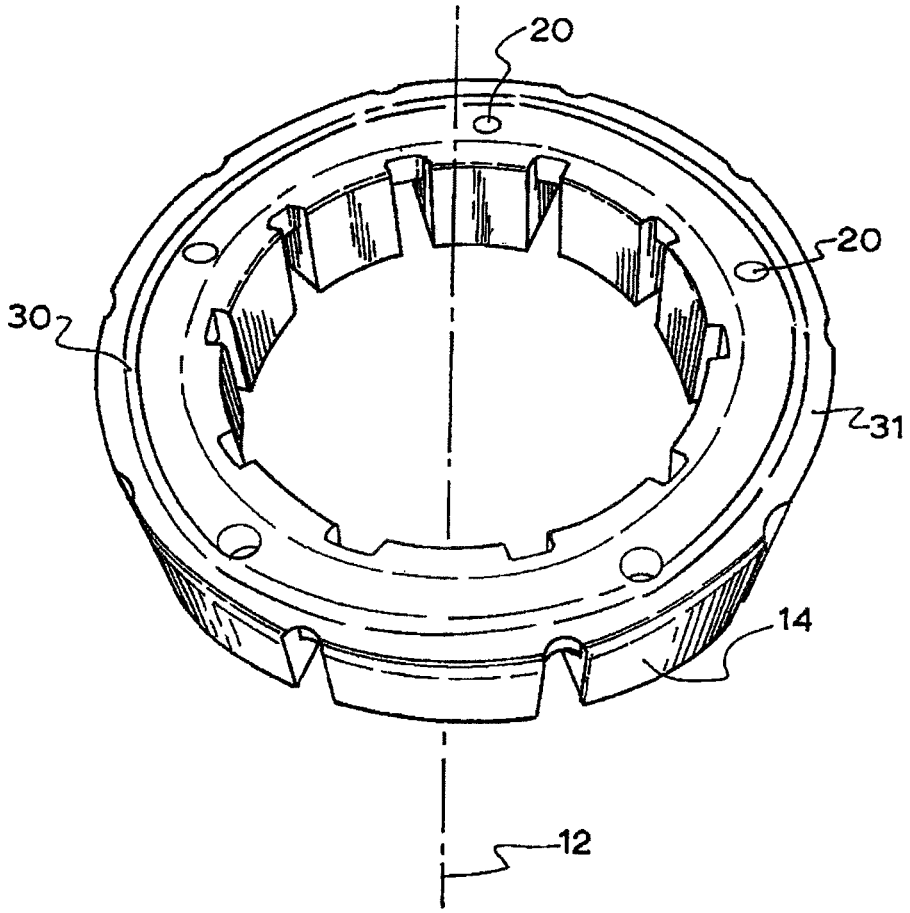
FIG. 2 shows from below a perspective view of one embodiment of the cutting member of FIG. 1.
Figure 3:
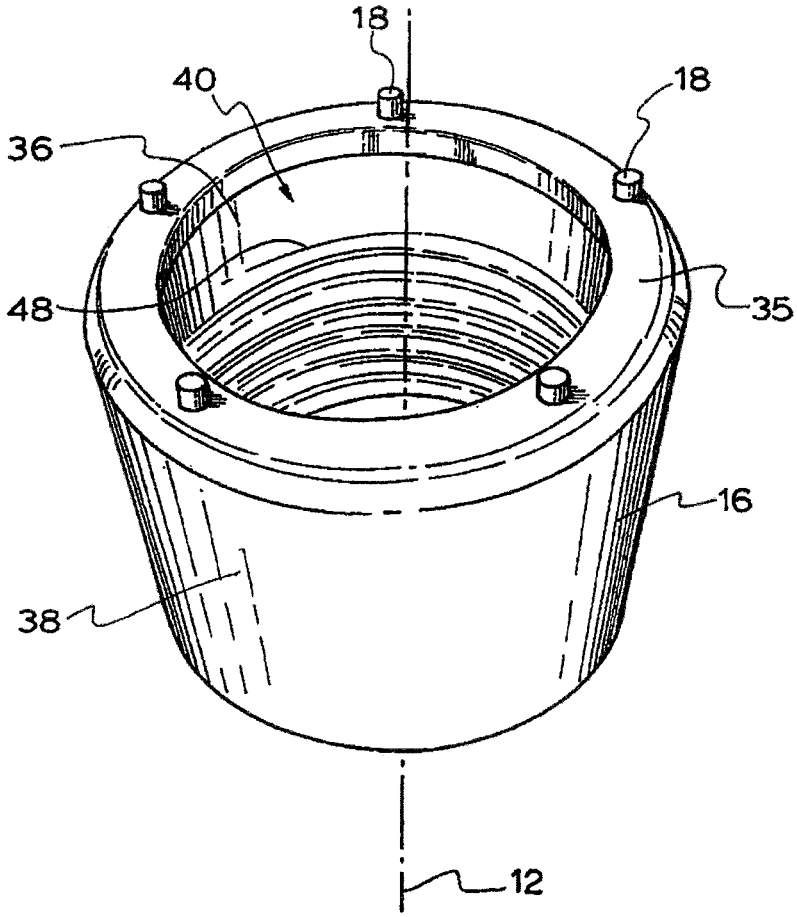
FIG. 3 shows from above a perspective view of the barrel of FIG. 1.

Alternatively, as shown in FIGS. 2 and 3, there are spigots 18 locatable in a corresponding recesses 20, the spigot being located on the barrel 16 and the recesses being located on the cutting member 14 or vice versa. This may not be enough to fix the cutting member and barrel together, and so the spigots 18 may be tapered and securely pressed into the corresponding recesses 20, for example. The cutting member 14 also has a flange 31 that telescopes with a corresponding flange 35 of the barrel 16.

The cutting member 14 may be metallurgically fixed to the barrel 16 by, for example, low temperature induction brazing, in cases were there are no co-operating elements such as threads, spigots & recesses for example, or to supplement them. A low temperature braze, such as a silver braze, is advantageous because the drill bit can be heated above the melting point of the braze (above 425° C. typically) and the cutting member detached from the barrel without overheating and damaging either the barrel or cutting member. A worn out or damaged barrel or cutting member can then be replaced without requiring replacement of the whole drill bit. Alternatively, the drill bit could be reconfigured by replacing the cutting member or barrel as required without requiring a whole new bit. Brazing may prevent inadvertent separation of the cutting member from the barrel, for example if the parts are attached by a thread and the drill bit is spun the wrong way. A drill bit wherein an adhesive, such as a cyanoacrylate based adhesive, is used instead of silver brazing has similar advantages.

Figure 4:
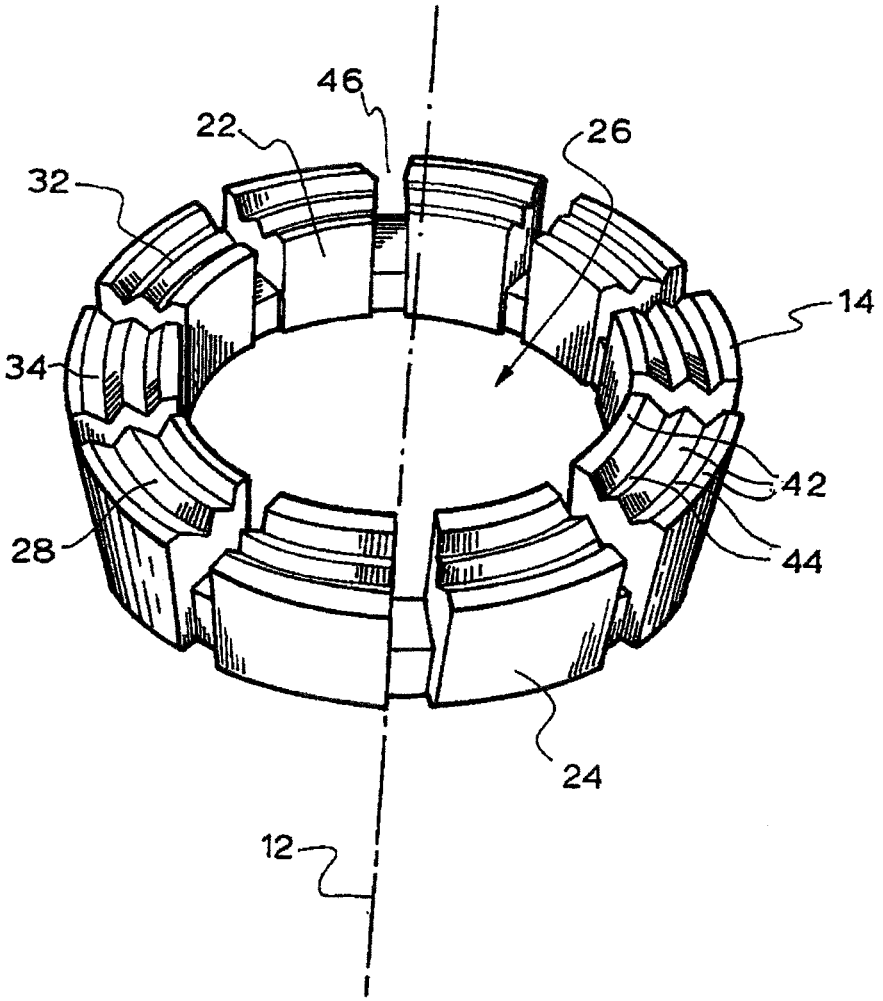
FIG. 4 shows from above a perspective view of the cutting member of FIG. 3.

As shown in FIG. 4, the cutting member 14 has cylindrical inner 22 and outer 24 surfaces centered on the axis 12, the inner surface 22 defining an aperture 26 passing through the cutting member 14. The cylindrical aperture 26 receives a core sample as the bit 10 drills into the ground or structure. The inner 22 and/or outer 24 surfaces comprise wear resistant matrices, such as a diamond/tungsten carbide and metal composite, which in some circumstances increases the life of the drill bit.

The cutting member 14 has a cutting face 28 (FIG. 4) and a backing face 30 (FIG. 2). The backing face is located adjacent the barrel 16 when joined to it. The faces 28,30 are spaced apart along the axis 12. The cutting face 28 has a plurality of cutting teeth or elements such as 32,34. The cutting teeth or elements 32,34 are arranged in a turret or crown-like ring formation. The cutting face 28 has a series of concentric hill 42 and valley 44 formations running around the axis 12. The cutting member 14 in this embodiment, is slotted to form a plurality of passage ways such as 46. The slots cut through the inner 22 and outer 24 surfaces and also the cutting face 28 itself. The passageways allow lubricant flow and the transport of drilling detritus or debris therethrough. The lubricant is typically water injected through the bit.

The backing face 30 may comprise a composite having a plurality of relatively large diamonds or other super hard constituents, to resist wear and keep the outer 24 and inner 22 diameters in gauge.

As shown in FIG. 3, the barrel 16 has cylindrical inner 36 and outer 38 barrel surfaces centered on the axis 12, the inner barrel surface defining an aperture 40 passing through the barrel 16. The cylindrical aperture 40 is continuous with the aperture 26 passing through the cutting member to form a greater drill bit aperture into which the core sample is received. The inner 36 and/or outer 38 barrel surfaces comprise wear resistant matrices, which in some circumstances increases the life of the drill bit. The barrel is substantially made of a steel, such as a carbon steel. The inner surface of the barrel has a grooved thread such as 48 for joining it to a threaded drill string.

The barrel 16 is arranged to stabilize the bit during drilling. This is achieved, in this embodiment, at least in part by having a barrel 16 longer than the cutting member 14.

To make the drill bit 10, first a cutting member 14 and barrel 16 are provided. The barrel 16 is separate to the cutting member 14. Then, the barrel 16 is located adjacent the cutting member 14 and fixed to it. These last steps are achieved in some embodiments by screwing the barrel 16 and cutting member 14 together. In some other embodiments, they are brazed together. Thus, the barrel and cutting member are separate in that they are formed separately, and not for example, made in the same mold.

In some embodiments a green cutting member is first formed that is later sintered or hot isostatic pressed to form the final member 14. Forming a green cutting member, in this embodiment, includes distributing diamonds in a metallic powder to form a composite material precursor from which the green cutting member is at least in part formed. The composite material precursor is then placed in a cutting member mould, and pressed into it. The composite material precursor is one of a plurality of different composite material precursors which are separately located in the cutting mould to form a cutting member having elements. Typically, the elements are layered like a sandwich.

A layer containing an alloy is placed over the composite material precursor in the mould. The alloy infiltrates and binds the composite during sintering or hot isostatic pressing of the green cutting member. Alternatively, the composite material precursors may include a binder premixed to facilitate self infiltration or self sintering powders may be used to avoid the use of a liquid phase.

The co-operating engagement element of the cutting member, such as a thread or recess, may be formed by the mold or a mold insert or by machining or cutting the green member.

The diamonds may be first encapsulated in a layer of material which is then semi- or fully-sintered. The material may be a metal powder that provides plasticity and in-filling between the diamonds during sintering.

The cutting face 32 itself contains sandwich segments and/or increased wear resistant matrices at the outer and/or inner diameters to prevent premature wear and early bit retrieval.

The cutting member and barrel are thus formed of different materials.

Now that embodiments have been described, it will be appreciated that some embodiments have some of the following advantages:

- The drill bit face is produced without producing waste, a typical by product of machined bits, which is more economical;
- The drill bit face is produced without machining which is labor and cost effective;
- The steel barrel stabilizes the bit during drilling without an intermediate stabilizer;
- The cutting member and barrel can be fabricated of different materials as is appropriate for each part, through completely different processes, for example sintering of a steel barrel which may soften, weaken and decrease the ductility of a carbon steel barrel can be avoided, while the crown may be sintered, resulting in a better bit;
- No expensive and consumable graphite moulds are required which must be destroyed to remove the molded part inside;
- High production capacity is possible;
- The manufacturing process is relatively very fast and cheap.
- The manufacturing process is highly repeatable.

It will be appreciated that numerous variations and/or modifications may be made to the embodiments without departing from the spirit or scope of the invention. For example, the bit may not be a core bit but some other type of bit. The present embodiments are, therefore, to be considered in all respects as illustrative and not restrictive.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The disclosures in Australian patent application No. 2008205690, from which this application claims priority, are incorporated herein by reference.

The invention claimed is:

1. A drill bit having an axis, the drill bit comprising:

a barrel;

a cutting member fixed to the barrel, the barrel being arranged to engage a drill shaft for driving the drill bit around the axis, the barrel and the cutting member being adjacently located on the axis; and an aperture centered on the axis, the aperture passing completely through both the cutting member and barrel, wherein the cutting member has a cutting face and a backing face, the faces being spaced apart along the axis and the backing face located adjacent the barrel, wherein the cutting face comprises a plurality of cutting teeth or elements, wherein the backing face comprises a composite having a plurality of diamonds or other super hard constituents and a flange on a radially outermost portion, wherein the flange has a radial width that tapers in the axial direction, and wherein the flange of the cutting member telescopes outwardly of a corresponding flange of the barrel.

2. A drill bit defined by claim 1 wherein the cutting member and barrel are mechanically fixed together by a pair of engaged cooperating elements, each of the pair of elements being located on one of the barrel and cutting member respectively.

3. A drill bit defined by claim 2 wherein the cooperating elements comprise a pair of complimentary threads, each of the threads being formed on one of the cutting member and barrel respectively.

4. A drill bit defined by claim 2 wherein the cooperating elements comprise a spigot located in a corresponding recess, the spigot and recess being located on one of the cutting member and barrel respectively.

5. A drill bit defined by claim 1 wherein the cutting member is metallurgically fixed to the barrel.

6. A drill bit defined by claim 1 wherein the cutting member has cylindrical inner and outer surfaces centered on the axis, the inner surface surrounding the aperture passing through the cutting member.

7. A drill bit defined by claim 6 wherein the inner and/or outer surfaces comprise wear resistant matrices.

8. A drill bit defined by claim 1 wherein the cutting member comprises a plurality of elements in a layered configuration.

9. A drill bit defined by claim 1 wherein the cutting member and barrel are formed of different materials.

10. A drill bit defined by claim 1 wherein the cutting member is formed of one or more composite materials.

11. A drill bit defined by claim 1 wherein the barrel has cylindrical inner and outer barrel surfaces centered on the axis, the inner barrel surface surrounding the aperture passing through the barrel.

12. A drill bit defined by claim 11 wherein the inner and/or outer barrel surfaces comprise wear resistant matrices comprising a composite having a plurality of diamonds or other superhard constituents.

13. A drill bit defined by claim 1 wherein the barrel is arranged to stabilize the bit during drilling.

14. A drill bit defined by claim 13 wherein the barrel is longer than the cutting member.

15. A drill bit defined by claim 1 wherein the cutting member is detachably fixed to the barrel.

16. A drill bit defined by claim 1 wherein the cutting face has a series of concentric hill and valley formations running around the axis.

17. A drill bit defined by claim 1 wherein the cutting member is a unitary body with a circumference of a radial cross-section centered on the axis of a closed geometric shape, and wherein the cutting faces of individual cutting teeth or elements are separated by a passageway that extends toward the backing face and from the inner surface of the cutting member to the outer surface of the cutting member.

18. A drill bit defined by claim 1 wherein the cutting member has cylindrical inner and outer surfaces centered on the axis, the inner surface surrounding the aperture passing through the cutting member, and wherein at least one of the inner and outer surfaces of the cutting member comprise wear resistant matrices comprising a composite having a plurality of diamonds or other superhard constituents.

19. A method of making a drill bit having an axis, the method comprising the steps of:

providing a cutting member;

providing a barrel separate to the cutting member, the barrel being arranged to engage a drill shaft for driving the drill bit around the axis;

locating the barrel adjacent the cutting member on the axis; and fixing the barrel to the cutting member, wherein the cutting member has a cutting face and a backing face, the faces being spaced apart along the axis and the backing face located adjacent the barrel, wherein the cutting face comprises a plurality of cutting teeth or elements, wherein the backing face comprises a composite having a plurality of diamonds or other super hard constituents and a flange on a radially outermost portion, wherein the flange has a radial width that tapers in the axial direction, and wherein the flange of the cutting member telescopes outwardly of a corresponding flange of the barrel.

20. The method of claim 19, wherein the cutting member is first formed as a green cutting member that is then sintered or hot isostatic pressed, wherein forming the green cutting member includes distributing diamonds in a metallic powder to form a composite material precursor from which the green cutting member is at least in part formed.

21. The method of claim 19, wherein the cutting member has cylindrical inner and outer surfaces centered on the axis, the inner surface surrounding the aperture passing through the cutting member, and wherein at least one of the inner and outer surfaces of the cutting member comprise wear resistant matrices comprising a composite having a plurality of diamonds or other superhard constituents.

* * * * *